US009689386B2

(12) United States Patent
Fraser et al.

(10) Patent No.: US 9,689,386 B2
(45) Date of Patent: Jun. 27, 2017

(54) METHOD OF ACTIVE OIL MANAGEMENT FOR MULTIPLE SCROLL COMPRESSORS

(71) Applicants: Bruce A. Fraser, Manlius, NY (US); Ronald J. Duppert, Fayetteville, NY (US); Wayne P. Beagle, Chittenango, NY (US); Kurt William Robert Bessel, Mexico, NY (US)

(72) Inventors: Bruce A. Fraser, Manlius, NY (US); Ronald J. Duppert, Fayetteville, NY (US); Wayne P. Beagle, Chittenango, NY (US); Kurt William Robert Bessel, Mexico, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 651 days.

(21) Appl. No.: 13/950,467

(22) Filed: Jul. 25, 2013

(65) Prior Publication Data

US 2014/0037483 A1 Feb. 6, 2014

Related U.S. Application Data

(60) Provisional application No. 61/677,742, filed on Jul. 31, 2012, provisional application No. 61/677,756, (Continued)

(51) Int. Cl.
*F04C 18/02* (2006.01)
*F04C 23/00* (2006.01)
(Continued)

(52) U.S. Cl.
CPC ..... *F04C 18/02* (2013.01); *F04C 18/0215* (2013.01); *F04C 23/001* (2013.01); (Continued)

(58) Field of Classification Search
CPC .... F04C 18/02; F04C 18/0207; F04C 23/008; F04C 23/001; F04C 28/02; F04C 29/021; (Continued)

(56) References Cited

U.S. PATENT DOCUMENTS 3,360,958 A 1/1968 Miner
3,386,262 A 6/1968 Hackbart et al.
(Continued)

FOREIGN PATENT DOCUMENTS

CN 1318145 A 10/2001
CN 1985091 A 6/2007
(Continued)

OTHER PUBLICATIONS

U.S. Appl. No. 13/950,488, filed Jul. 25, 2013, Fraser et al.
U.S. Appl. No. 13/932,540, filed Jul. 1, 2013, Fraser et al.

*Primary Examiner* — Charles Freay
*Assistant Examiner* — Philip Stimpert
(74) *Attorney, Agent, or Firm* — Reinhart Boerner Van Deuren P.C.

(57) ABSTRACT

A method of operating a refrigeration system uses a plurality of compressors in connected parallel. The method includes returning refrigerant and oil to the compressors, the refrigerant also having oil entrained therein, separating the oil entrained in the refrigerant, and returning more of the oil entrained in the refrigerant to a lead compressor of the plurality of compressors regardless of whether the lead compressor is operating. The method also includes connecting the oil sumps of all of the plurality of compressors such that oil is supplied from the lead compressor to at least one non-lead compressor of the plurality of compressors when the at least one non-lead compressor is operating.

11 Claims, 9 Drawing Sheets

Related U.S. Application Data filed on Jul. 31, 2012, provisional application No. 61/793,988, filed on Mar. 15, 2013.

(51) Int. Cl.
*F04C 28/02* (2006.01)
*F04C 29/02* (2006.01)

(52) U.S. Cl.
CPC ..... *F04C 23/008* (2013.01); *F04C 28/02* (2013.01); *F04C 29/021* (2013.01); *F04C 2270/24* (2013.01)

(58) Field of Classification Search
CPC .. F04C 18/0215; F04B 39/02; F04B 39/0207; F04B 39/023; F04B 39/0284
See application file for complete search history.

(56) References Cited

U.S. PATENT DOCUMENTS

| | | | | |
|---|---|---|---|---|
| 3,581,519 | A | 6/1971 | Garrett, Jr. et al. | |
| 4,729,228 | A * | 3/1988 | Johnsen | F04B 39/0207 137/561 A |
| 5,901,559 | A | 5/1999 | Westermeyer et al. | |
| 6,599,109 | B2 | 7/2003 | Zamudio et al. | |
| 6,736,607 | B2 | 5/2004 | Ginies et al. | |
| 7,316,291 | B2 | 1/2008 | Thomsen et al. | |
| 7,421,850 | B2 | 9/2008 | Street et al. | |
| 7,721,757 | B2 | 5/2010 | Ginies et al. | |
| 8,079,830 | B2 | 12/2011 | Süss et al. | |
| 8,337,183 | B2 | 12/2012 | Milliff et al. | |
| 2001/0026766 | A1 | 10/2001 | Terai et al. | |
| 2005/0229627 | A1 | 10/2005 | De Bernardi et al. | |
| 2006/0059929 | A1 | 3/2006 | Sakitani et al. | |
| 2007/0074534 | A1 | 4/2007 | Sato | |
| 2009/0035168 | A1 | 2/2009 | Ginies et al. | |
| 2009/0041602 | A1 | 2/2009 | Ginies et al. | |
| 2009/0081062 | A1 | 3/2009 | Upadhye et al. | |
| 2010/0186433 | A1 | 7/2010 | Galante et al. | |
| 2010/0186439 | A1 | 7/2010 | Ogata et al. | |
| 2012/0017636 | A1 | 1/2012 | Wada et al. | |

FOREIGN PATENT DOCUMENTS

| | | | |
|---|---|---|---|
| CN | 101999064 | A | 3/2011 |
| EP | 1 120 611 | A1 | 8/2001 |
| JP | 04287880 | A | 10/1992 |
| JP | 05071811 | A | 3/1993 |
| JP | H05272477 | A | 10/1993 |
| JP | 07035045 | A | 2/1995 |
| JP | H0829018 | A | 2/1996 |
| JP | H0861809 | A | 3/1996 |
| JP | 08128764 | A | 5/1996 |
| JP | 2605498 | B2 | 4/1997 |
| JP | 2001132645 | A | 5/2001 |
| JP | 2005076515 | A | 3/2005 |
| KR | 1020050065258 | A | 6/2005 |
| WO | WO 97/16647 | A1 | 5/1997 |
| WO | WO 2005/103492 | A1 | 11/2005 |
| WO | WO 2008/081093 | A2 | 7/2008 |

* cited by examiner

METHOD OF ACTIVE OIL MANAGEMENT FOR MULTIPLE SCROLL COMPRESSORS

CROSS-REFERENCE TO RELATED PATENT APPLICATIONS

This patent application claims the benefit of U.S. Provisional Patent Application Nos. 61/677,742, filed Jul. 31, 2012, 61/677,756, filed Jul. 31, 2012, and 61/793,988 filed Mar. 15, 2013, the entire teachings and disclosures of which are incorporated herein by reference thereto.

FIELD OF THE INVENTION

This invention generally relates to multi-compressor refrigeration systems.

BACKGROUND OF THE INVENTION

A particular example of the state of the art with respect to suction gas distribution in a parallel compressor assembly is represented by WIPO patent publication WO2008/081093 (Device For Suction Gas Distribution In A Parallel Compressor Assembly, And Parallel Compressor Assembly), which shows a distribution device for suction gas in systems with two or more compressors, the teachings and disclosure of which is incorporated in its entirety herein by reference thereto. A particular example of oil management in systems having multiple compressors is disclosed in U.S. Pat. No. 4,729,228 (Suction Line Flow Stream Separator For Parallel Compressor Arrangements), the teachings and disclosure of which is incorporated in its entirety herein by reference thereto.

Embodiments of the invention described herein represent an advancement over the current state of the art. These and other advantages of the invention, as well as additional inventive features, will be apparent from the description of the invention provided herein.

BRIEF SUMMARY OF THE INVENTION

In one aspect, embodiments of the invention provide a method of operating a refrigeration system uses a plurality of compressors connected in parallel. The method includes returning refrigerant to the compressors, the refrigerant having oil entrained therein, separating the oil from the refrigerant, and returning more of the oil to a lead compressor of the plurality of compressors regardless of whether the lead compressor is operating. The method also includes connecting the oil sumps of all of the plurality of compressors such that oil is supplied from the lead compressor to at least one non-lead compressor of the plurality of compressors when the at least one non-lead compressor is operating.

Further, the method may include providing a suction header, also referred to as a common supply line, configured to supply more oil to the lead compressor than is supplied to the non-lead compressors. An embodiment of the method further includes providing, to an inlet port for each of the plurality of compressors, a separate inlet supply line, wherein configuring the common supply line to supply more oil to the lead compressor comprises restricting the inlet supply lines to each of the non-lead compressors. Also, the restriction of the inlet supply lines may be designed to create reduced suction pressures at the inlet ports of the non-lead compressors, as compared to the suction pressure at the inlet port of the lead compressor. In certain embodiments, each of the compressors discharges refrigerant and oil to a common outlet line.

In certain embodiments, the method includes constructing a refrigeration system by connecting a plurality of scroll compressors in parallel. A further embodiment of the method includes locating each pipe connection at the same horizontal level or oil sump level. Moreover, in particular embodiments, the method includes locating each pipe connection so that oil will flow out through the pipe connection from the lead compressor, whether or not the lead compressor is operating, to at least one of the non-lead compressors, which is operating. This flow will continue until the oil sump pressures in the oil sumps of the lead compressor and the at least one of the non-lead compressors are approximately the same.

In a particular embodiment, the method includes connecting the oil sumps of all of the plurality of compressors such that oil does not flow from the lead compressor to a non-lead compressor of the plurality of compressors when the non-lead compressor is not operating. In this case, the oil does not flow to the non-operating non-lead compressor due to a rise in oil sump pressure in that non-operating non-lead compressor In another aspect, embodiments of the invention provide a refrigeration system that includes a plurality of compressors connected in parallel. The plurality of compressors includes at least one lead compressor, and each compressor has a compressor housing. There is a common supply line for supplying refrigerant and oil to each of the plurality of compressors. The common supply line is configured to return more oil to the lead compressor than to the non-lead compressors of the plurality of compressors. Each compressor has an opening in a lower portion of its respective compressor housing, and each opening is configured to allow a flow of oil to and from an oil sump for its respective compressor. Further, each opening is coupled to a pipe so that the oil sumps for each of the plurality of compressors are in fluid communication. Also, each opening is located such that the oil can be distributed from the lead compressor to any of the non-lead compressors of the plurality of compressors whether or not the lead compressor is operating.

In a particular embodiment of the invention, the lead compressor, whether or not it is operating, distributes oil to any of the non-lead compressors of the plurality of compressors that are operating. In certain embodiments, each of the plurality of compressors has an inlet supply line coupled to the common supply line, and the inlet supply line for any of the plurality of compressors, other than the lead compressor, has a restriction to reduce the flow of oil into the compressor. In particular embodiments, the restriction in the inlet supply line is configured to create reduced suction pressure at the inlet port of its respective compressor.

Further, it is contemplated that embodiments of the invention include multi-compressor systems in which the individual compressors have different capacities. The use of a plurality of compressors in a refrigeration system, where the individual compressors have different volume indexes is disclosed in U.S. Patent Publication No. 2010/0186433 (Scroll Compressors With Different Volume Indexes and Systems and Methods For Same), filed on Jan. 22, 2010, the teachings and disclosure of which is incorporated in its entirety herein by reference thereto.

In yet another aspect, embodiments of the invention provide a refrigeration system that includes a plurality of compressors connected in parallel. The plurality of compressors includes at least one lead compressor, and each compressor has a compressor housing. There is a supply line for supplying refrigerant and oil to the at least one lead compressor, from which the refrigerant and oil is supplied to remaining compressors of the plurality of compressors. Each compressor has an opening in a lower portion of its respective compressor housing, and each opening is configured to allow a flow of oil to and from an oil sump for its respective compressor. Further, each opening is coupled to a pipe so that the oil sumps for each of the plurality of compressors are in fluid communication. Also, each opening is located such that the oil can be distributed from the lead compressor to any of the remaining compressors of the plurality of compressors whether or not the lead compressor is operating. In a particular embodiment, the lead compressor has a vertical header connected to the supply line, the vertical header arranged to drain oil into the oil sump in the lead compressor.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The following detailed description describes embodiments of the invention as applied in a multi-compressor refrigeration system. However, one of ordinary skill in the art will recognize that the invention is not necessarily limited to refrigeration systems. Embodiments of the invention may also find use in other systems where multiple compressors are used to supply a flow of compressed gas.

Figure 1:
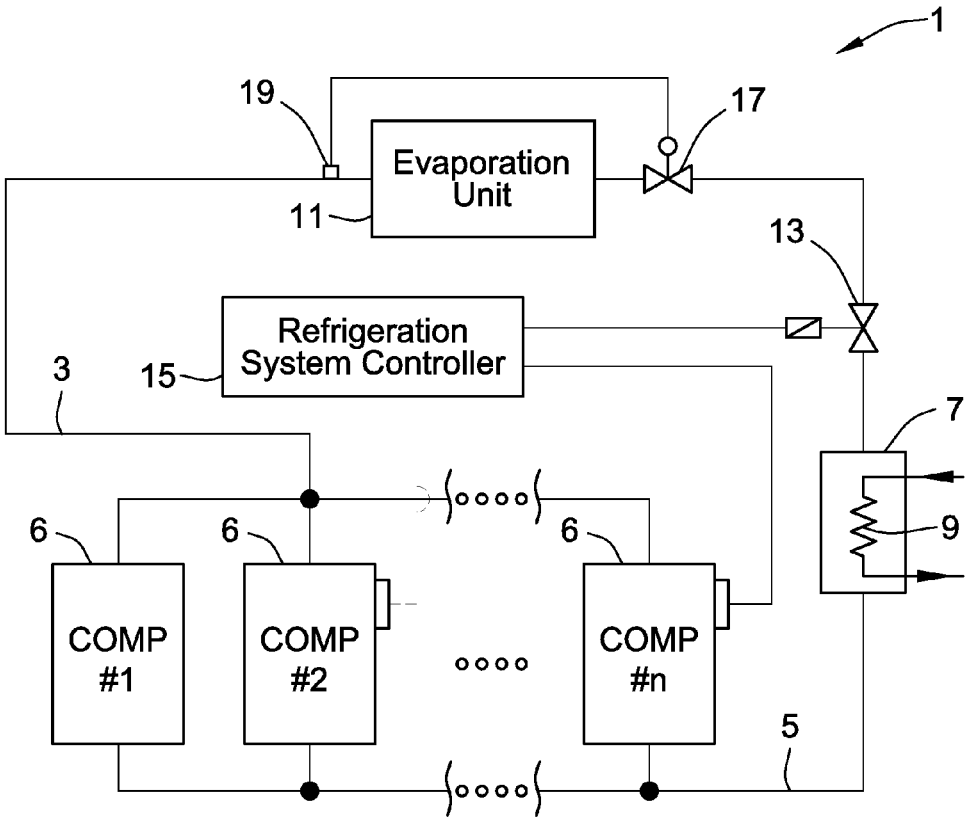
FIG. 1 is a block diagram of a multi-compressor refrigeration system, constructed in accordance with an embodiment of the invention.

FIG. 1 provides a schematic illustration of an exemplary multiple-compressor refrigeration system 1 having N compressors 6. The N compressors 6 of refrigeration system 1 are connected in a parallel circuit having inlet flow line 3 that supplies a flow of refrigerant to the N compressors 6, and outlet flow line 5 that carries compressed refrigerant away from the N compressors 6. In certain embodiments, the flow of refrigerant carries oil along with the flow of refrigerant, the oil used to lubricate moving parts of the compressor 6. As shown, the outlet flow line 5 supplies a condenser 7. In a particular embodiment, the condenser 7 includes a fluid flow heat exchanger 9 (e.g. air or a liquid coolant) which provides a flow across the condenser 7 to cool and thereby condense the compressed, high-pressure refrigerant.

An evaporation unit 11 to provide cooling is also arranged in fluid series downstream of the condenser 7. In an alternate embodiment, the condenser 7 may feed multiple evaporation units arranged in parallel. In the embodiment of FIG. 1, the evaporation unit 11 includes an shut off liquid valve 13, which, in some embodiments, is controlled by the refrigeration system controller 15 to allow for operation of the evaporation unit 11 to produce cooling when necessitated by a demand load on the refrigeration system 1, or to preclude operation of the evaporation unit 11 when there is no such demand. The refrigeration system controller 15 may also be directly connected to one or more of the N compressors 6. The evaporation unit 11 also includes an expansion valve 17 that may be responsive to, or in part controlled by, a downstream pressure of the evaporation unit 11, sensed at location 19. The expansion valve 17 is configured to control the discharge of refrigerant into the evaporation unit 11, wherein due to the evaporation, heat is absorbed to evaporate the refrigerant to a gaseous state thereby creating a cooling/refrigeration effect at the evaporation unit 11. The evaporation unit 11 returns the expanded refrigerant in a gaseous state along the inlet flow line 3 to the bank of N compressors 6.

It should be noted that, for the sake of convenience, embodiments of the invention are frequently described hereinbelow with respect to their application in systems having multiple scroll compressors for compressing refrigerant. While particular advantages and configurations are shown for scroll compressor, some of these embodiments are not limited to scroll compressors, but may find use in a variety of compressors other than scroll compressors.

Figure 2:
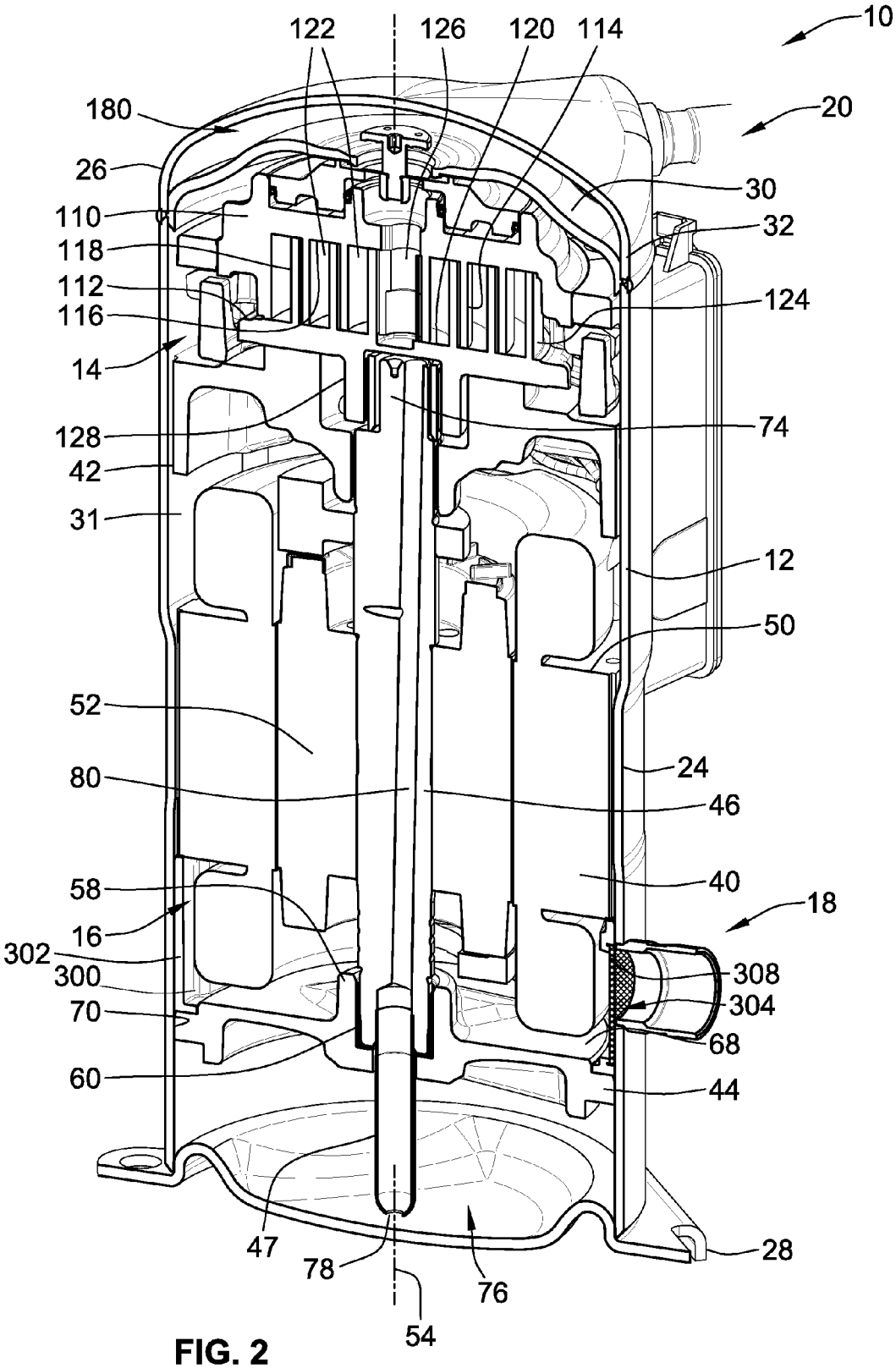
FIG. 2 is a cross-sectional view of a scroll compressor, constructed in accordance with an embodiment of the invention.

An embodiment of the present invention is illustrated in FIG. 2, which illustrates a cross-sectional view of a compressor assembly 10 generally including an outer housing 12 in which a compressor apparatus 14 can be driven by a drive unit 16. In the exemplary embodiments described below, the compressor apparatus 14 is a scroll compressor. Thus, the terms compressor apparatus and scroll compressor are, at times, used interchangeably herein. The compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The compressor assembly 10 is operable through operation of the drive unit 16 to operate the compressor apparatus 14 and thereby compress an appropriate refrigerant or other fluid that enters the refrigerant inlet port 18 and exits the refrigerant outlet port 20 in a compressed high pressure state.

The outer housing 12 may take various forms. In a particular embodiment, the outer housing 12 includes multiple housing or shell sections, and, in certain embodiments, the outer housing 12 has three shell sections that include a central housing section 24, a top end housing section 26 and a bottom end housing section, or base plate 28. In particular embodiments, the housing sections 24, 26, 28 are formed of appropriate sheet steel and welded together to make a permanent outer housing 12 enclosure. However, if disassembly of the outer housing 12 is desired, methods for attaching the housing sections 24, 26, 28 other than welding may be employed including, but not limited to, brazing, use of threaded fasteners or other suitable mechanical means for attaching sections of the outer housing 12.

The central housing section 24 is preferably tubular or cylindrical and may abut or telescopically fit with the top and bottom end housing sections 26, 28. As can be seen in the embodiments of FIG. 2, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. While the top end housing section 26 is generally dome-shaped and includes a cylindrical side wall region 32 to mate with the center housing section 24 and provide for closing off the top end of the outer housing 12, in particular embodiments, the bottom end housing section may be dome-shaped, cup-shaped, or substantially flat. As shown in FIG. 2, assembly of the outer housing 12 results in the formation of an enclosed chamber 31 that surrounds the drive unit 16, and partially surrounds the compressor apparatus 14.

In an exemplary embodiment of the invention in which a scroll compressor 14 is disposed within the outer housing 12, the scroll compressor 14 includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 which is typically arranged in the form of a spiral. Similarly, the movable scroll compressor body 112 includes a second scroll rib 118 projecting axially from a plate-like base 120 and is in the shape of a similar spiral. The scroll ribs 114, 118 engage with one another and abut sealingly on the respective surfaces of bases 120, 116 of the respectively other compressor body 112, 110.

In a particular embodiment of the invention, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via an adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearing members 42, 44.

Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction along, or parallel to, the central axis 54, while the terms "radial' or "radially-extending" indicates a feature that projects or extends in a direction perpendicular to the central axis 54.

In particular embodiments, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

As can be seen in the embodiment of FIG. 2, the drive shaft 46 includes an impeller tube 47 attached at the bottom end of the drive shaft 46. In a particular embodiment, the impeller tube 47 is of a smaller diameter than the drive shaft 46, and is aligned concentrically with the central axis 54. The drive shaft 46 and impeller tube 47 pass through an opening in the cylindrical hub 58 of the lower bearing member 44. The impeller tube 47 has an oil lubricant passage and inlet port 78 formed at the end of the impeller tube 47.

At its upper end, the drive shaft 46 is journaled for rotation within the upper bearing member 42. Hereinafter, the upper bearing member 42 is also referred to as a "crankcase". In particular embodiments, the drive shaft 46 further includes an offset eccentric drive section 74 which typically has a cylindrical drive surface about an offset axis that is offset relative to the central axis 54. This offset drive section 74 may be journaled within a central hub 128 of the movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which a suitable amount of oil lubricant may be stored.

It can also be seen that FIG. 2 shows an embodiment of a suction duct 300 in use in scroll compressor assembly 10. In certain embodiments, the suction duct 300 comprises a plastic molded ring body 302 that is situated in a flow path through the refrigerant inlet port 18 and in surrounding relation of the motor 40. The suction duct 300 is arranged to direct and guide refrigerant into the motor cavity for cooling the motor 40 while at the same time filtering out contaminants and directing lubricating oil around the periphery of the suction duct 300 to the oil sump 76.

Additionally, in particular embodiments, the suction duct 300 includes a screen 308 in the opening 304 that filters refrigerant gas as it enters the compressor through the inlet port 18, as illustrated in FIG. 2. The screen 308 is typically made of metal wire mesh, such as a stainless steel mesh, in which the individual pore size of the screen 308 typically ranges from 0.5 to 1.5 millimeters.

As shown in FIG. 2 and as mentioned above, the suction duct 300 is positioned in surrounding relation to the motor 40, and, in some embodiments, includes a generally arcuate outer surface that is in surface to surface contact with the inner surface of the generally cylindrical outer housing 12. In particular embodiments, the suction duct 300 includes a sealing face that forms a substantial seal between the outer housing 12 and the section duct 300. The sealing face can surround and seal the opening 304 to ensure that refrigerant flows into the motor cavity. The seal may be air tight, but is not required to be. This typically will ensure that more than 90% of refrigerant gas passes through the screen 308 and preferably at least 99% of refrigerant gas. By having a seal between the sealing face and the portion of the housing outer 12 surrounding the inlet port 18, the suction duct 300 can filter large particles from the refrigerant gas that enters through the inlet port 18, thus preventing unfiltered refrigerant gas from penetrating into the compressor, and can direct the cooling refrigerant into the motor cavity for better cooling of the motor 40 while directing oil down to oil sump 76.

During operation, the refrigerant gas flowing into the inlet port 18 is cooler than compressed refrigerant gas at the outlet port 20. Further, during operation of the scroll compressor 14, the temperature of the motor 40 will rise. Therefore, it is desirable to cool the motor 40 during operation of the compressor. To accomplish this, cool refrigerant gas that is drawn into the compressor outer housing 12 via inlet port 18 flows upward through and along the motor 40 in order to reach the scroll compressor 14, thereby cooling the motor 40.

Furthermore, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be required.

Figure 3:
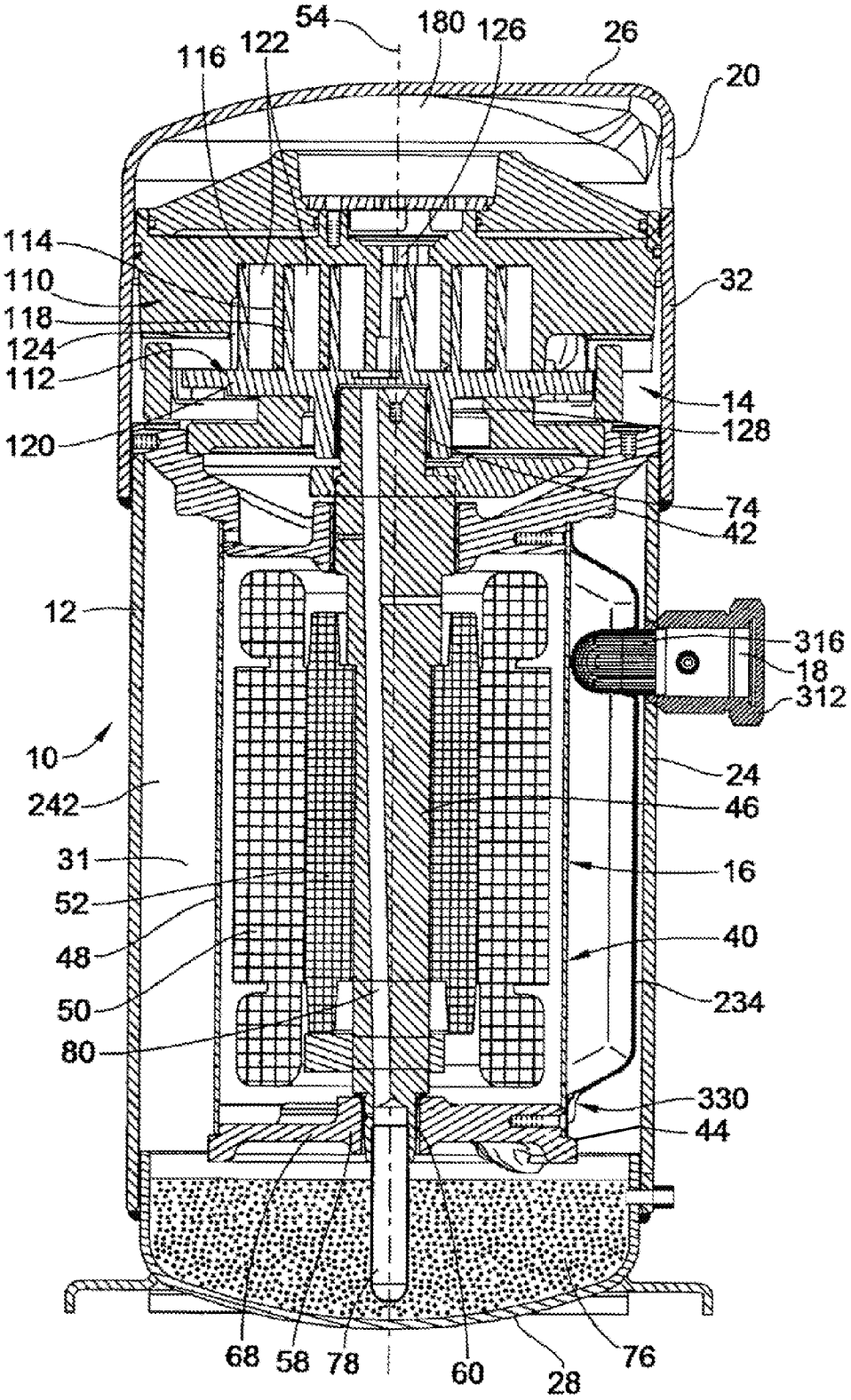
FIG. 3 is a cross-sectional view of a scroll compressor, constructed in accordance with an alternate embodiment of the invention.
Figure 4:
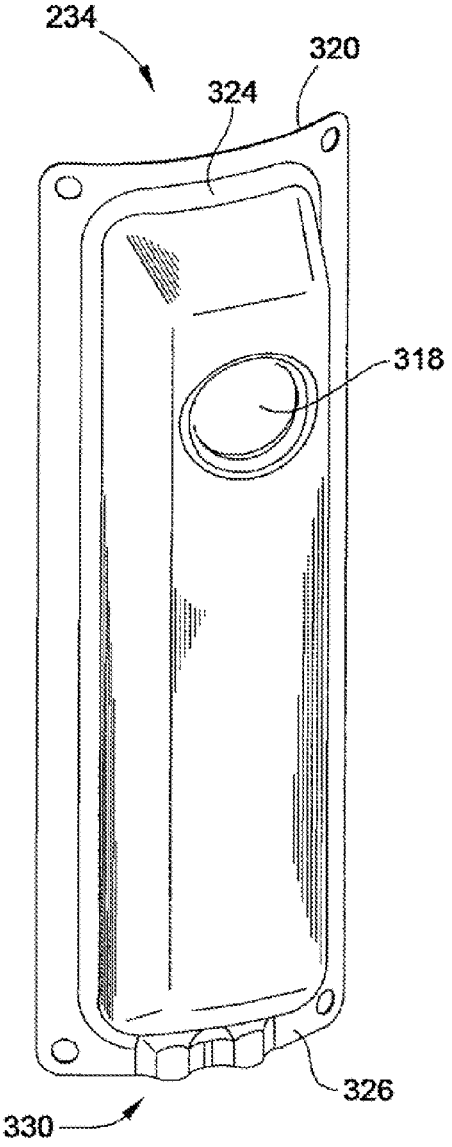
FIG. 4 is a perspective front view of a suction duct, constructed in accordance with an embodiment of the invention.
Figure 5:
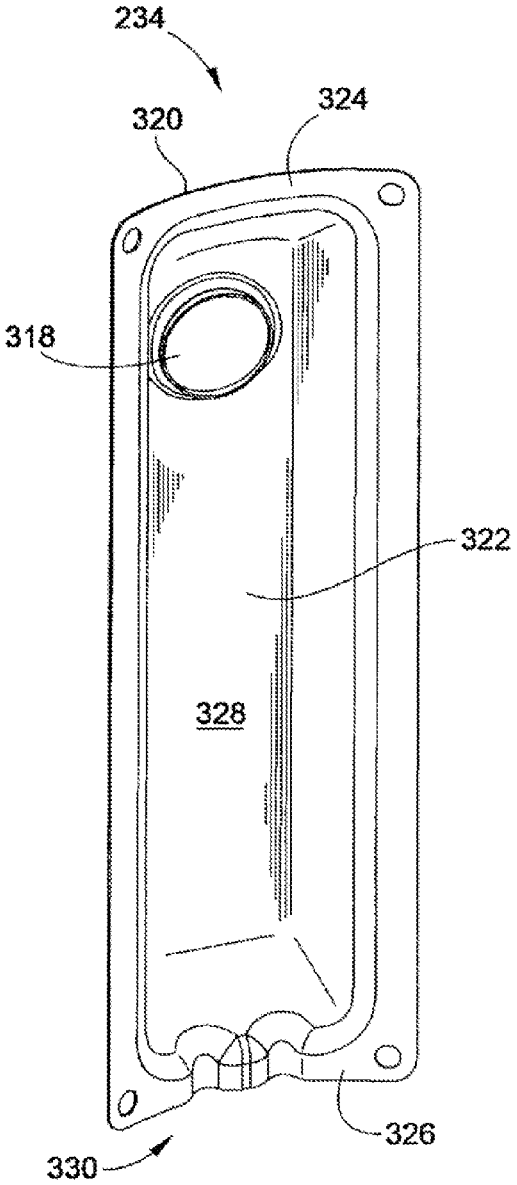
FIG. 5 is a perspective rear view of the suction duct of FIG. 4.

FIG. 3 illustrates a cross-sectional view of an alternate embodiment of a compressor assembly 10. In FIG. 3, it can be seen that a suction duct 234 may be employed to direct incoming fluid flow (e.g. refrigerant) through the housing inlet port 18. To provide for the inlet port 18, the outer housing 12 includes an inlet opening in which resides an inlet fitting 312. In a particular embodiment shown in FIGS. 4 and 5, the suction duct 234 comprises a stamped sheet steel metal body having a constant wall thickness with an outer generally rectangular and arcuate mounting flange 320 which surrounds a duct channel 322 that extends between a top end 324 and a bottom end 326. The entrance opening and port 318 is formed through a channel bottom 328 proximate the top end 324. This opening and port 318 provide means for communicating and receiving fluid from the inlet port 18 via a suction screen flange 316 (shown in FIG. 3) which is received through the outer housing wall of the compressor and into duct channel 322 of the suction duct 234.

A duct channel provides a fluid flow path to a drain port 330 at or near the bottom end 326 of the suction duct 234. In this embodiment, the drain port 330 extends through the bottom end 326 and thereby provides a port for draining lubricant oil into the lubricant oil sump 76, and also to communicate substantially the entire flow of refrigerant for compression to a location just upstream of the motor housing.

Not only does the suction duct 234 act to direct substantially the entire flow of refrigerant and oil from the inlet port 18 to a location upstream of the motor 40 and to direct fluid flow through the motor 40, but it also acts as a gravitational drain preferably by the port 330 being at the absolute gravitational bottom of the suction duct 234 or proximate thereto so as to drain lubricant received in the suction duct 234 into the lubricant oil sump 76. This can be advantageous for several reasons. First, when it is desirable to fill the lubricant oil sump 76 either at initial charting or otherwise, oil can readily be added through the inlet port 18, which acts also as an oil fill port so that oil will naturally drain through the suction duct 234 and into the oil sump 76 through the drain port 330. The outer housing 12 can thereby be free of a separate oil port. Additionally, the surfaces of the suction duct 234 and redirection of oil therein causes coalescing of oil lubricant mist, which can then collect within the duct channel 322 and drain through the drain port 330 back into the oil sump 76. Thus, direction of refrigerant as well as direction of lubricant oil is achieved with the suction duct 234.

During operation, the scroll compressor assemblies 10 are operable to receive low pressure refrigerant at the housing inlet port 18 and compress the refrigerant for delivery to a high pressure chamber 180 where it can be output through the housing outlet port 20. As is shown, in FIGS. 2 and 3, the suction duct 234, 300 may be disposed internally of the outer housing 12 to guide the lower pressure refrigerant from the inlet port 18 into outer housing 12 and beneath the motor housing. This allows the low-pressure refrigerant to flow through and across the motor 40, and thereby cool and carry heat away from the motor 40. Low-pressure refrigerant can then pass longitudinally through the motor housing and around through void spaces therein toward the top end of the where it can exit through a plurality of motor housing outlets in the motor housing 48 (shown in FIG. 3), or in the upper bearing member 42. Upon exiting the motor housing outlet, the low-pressure refrigerant enters an annular chamber 242 (shown in FIG. 3) formed between the motor housing 48 and the outer housing 12. From there, the low-pressure refrigerant can pass by or through the upper bearing member 42.

Upon passing through the upper bearing member 42, the low pressure refrigerant finally enters an intake area 124 of the scroll compressor bodies 110, 112. From the intake area 124, the lower pressure refrigerant is progressively compressed through chambers 122 to where it reaches its maximum compressed state at a compression outlet 126 where it subsequently passes through a check valve and into the high pressure chamber 180. From there, high-pressure compressed refrigerant may then pass from the scroll compressor assembly 10 through the outlet port 20.

Figure 6:
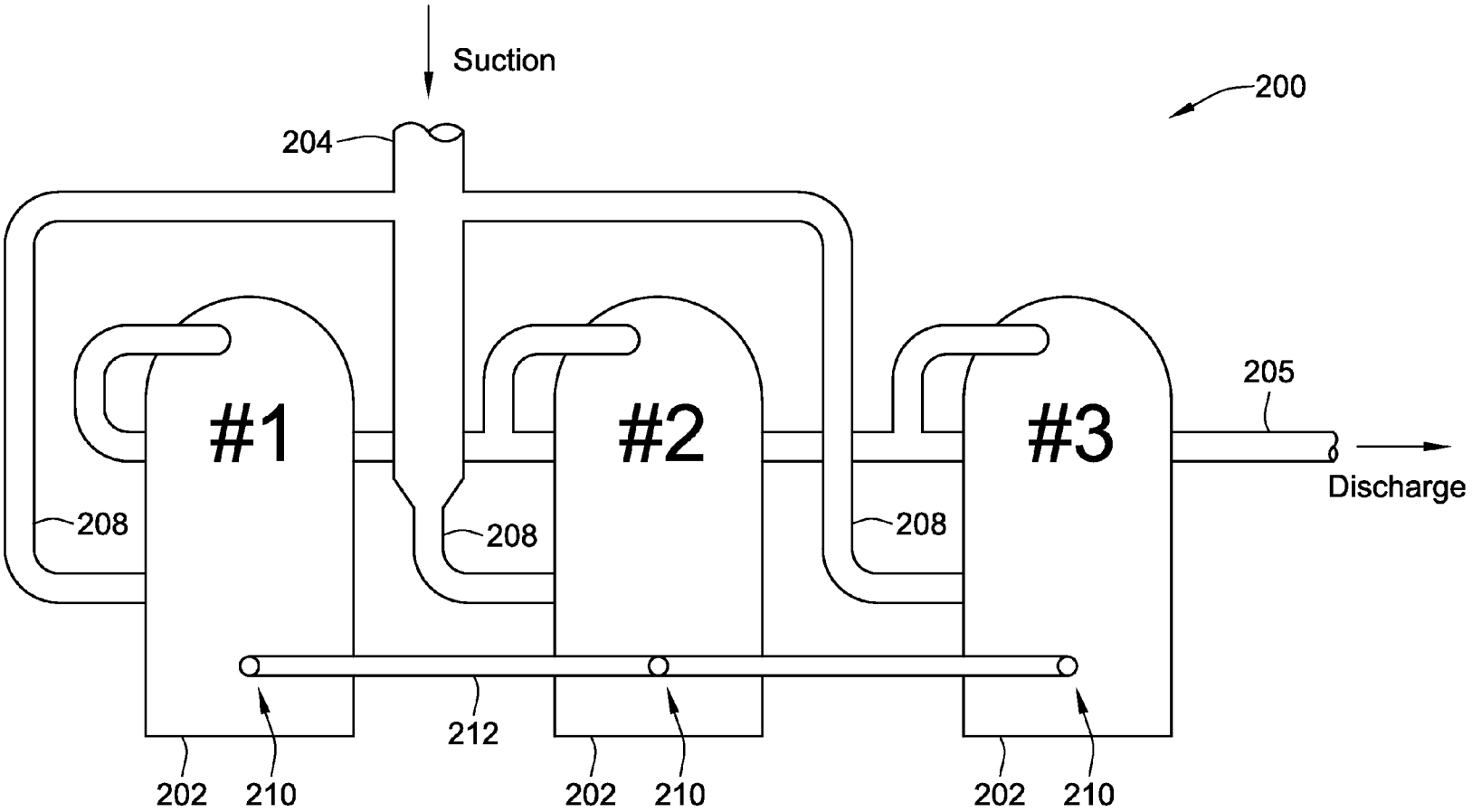
FIG. 6 is a schematic diagram of a multiple-compressor refrigeration system, constructed in accordance with an embodiment of the invention.
Figure 7:
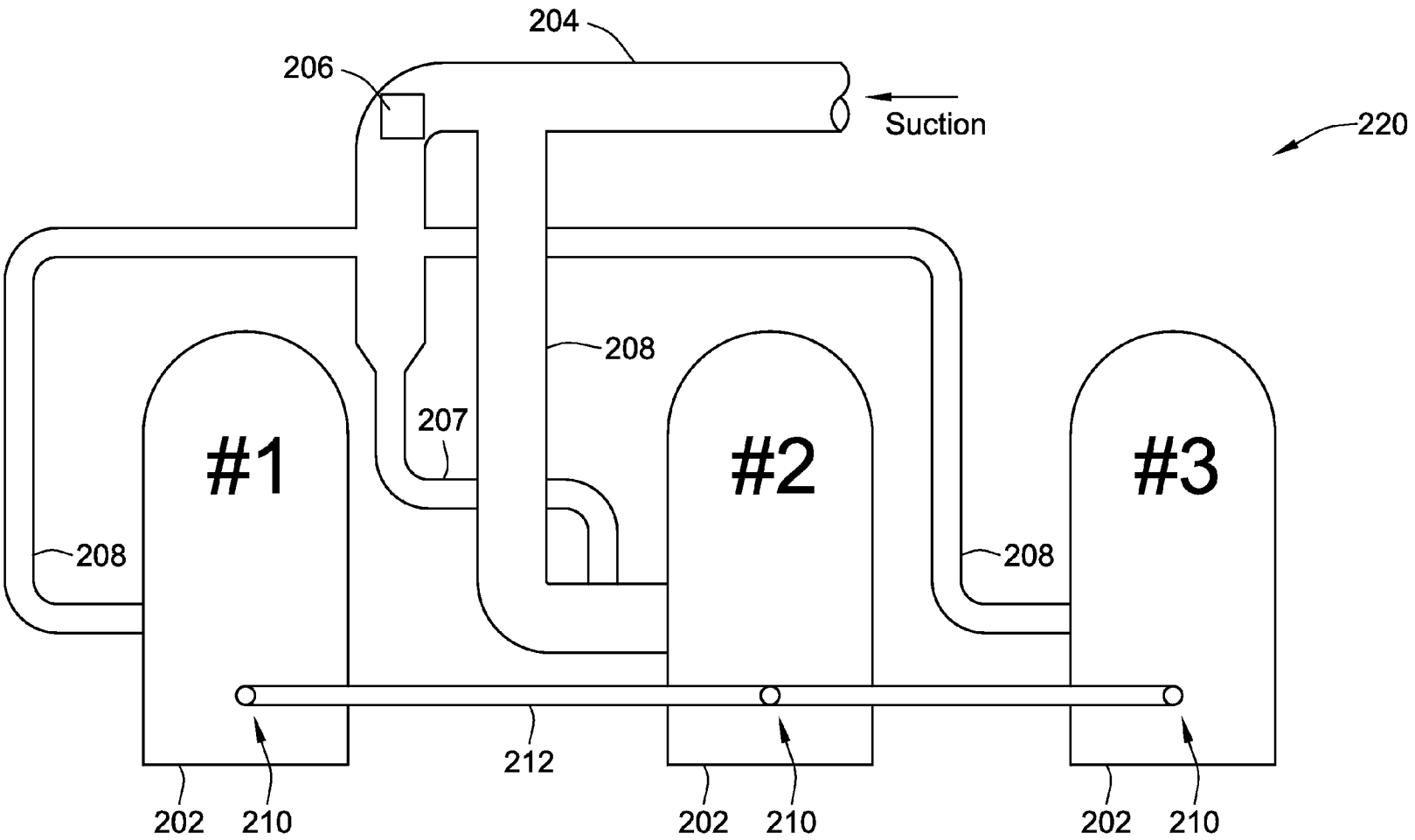
FIG. 7 is a schematic diagram of a multiple-compressor refrigeration system, constructed in accordance with an alternate embodiment of the invention.

FIGS. 6 and 7 are schematic diagrams showing two embodiments of multiple-compressor refrigeration systems 200, 220, such as the one shown in FIG. 1. In the refrigeration system 200 of FIG. 6, compressors #1, #2, and #3 202 are connected in parallel. In a particular embodiment of the invention, the compressors 202 are scroll compressors, similar or identical to those shown in FIGS. 2 and 3. However, in alternate embodiments, compressors other than scroll compressors may be used. Further, the embodiment of FIG. 6 shows the refrigeration system 200 having three compressors 202, though alternate embodiments of the invention may have fewer or greater than three compressors.

With respect to compressors #1, #2, and #3 202, the internal flow of refrigerant through the compressors 202 with their isolated oil sumps 76 configuration creates a pressure drop from the suction inlet port 18 to the oil sump 76 in each of the compressors that are running, due to the restriction of the gas flow. When any of these compressors 202 is shut off and there is no flow restriction, the oil sump 76 pressure will be relatively higher than a running compressor with the same suction inlet pressure. This pressure differential between the oil sump 76 of a running compressor and the oil sump 76 of an off compressor allows for oil distribution from the off compressor to the running compressors in the refrigeration system 200, 220.

In the arrangements shown in FIGS. 6 and 7, compressor #2 202 is the lead compressor. While all three compressors 202 receive a flow of refrigerant from a suction header, also referred to as a common supply line 204, and discharge refrigerant to a common discharge or outlet line 205 (shown in FIG. 6 only), the common supply line 204 is configured to deliver more lubricating oil to the lead compressor #2 202 than to the non-lead compressors #1 and #3 202. In certain embodiments, this is accomplished by restricting inlet supply lines 208 leading from the common supply line 204 to the non-lead compressors #1 and #3 202, thereby restricting the flow of oil to these compressors 202. However, as shown in FIG. 7, this may also be accomplished by providing an oil separator 206, which separates out oil from the flow of refrigerant and delivers most of the oil to the lead compressor #2 202 via an oil drain 207. Still, other methods of returning more oil to the lead compressor #2 202 may be used, including different piping configurations, and various types of oil separator devices that return oil directly to the oil sump 76 of the lead compressor #2 202. As referenced above, the suction piping may include a restriction which serves to create a lower pressure at the suction inlet 18 (shown in FIGS. 2 and 3) of non-lead compressors #1 and #3 202, as compared to the pressure at the suction inlet 18 of the lead compressor #2 202.

Figure 8:
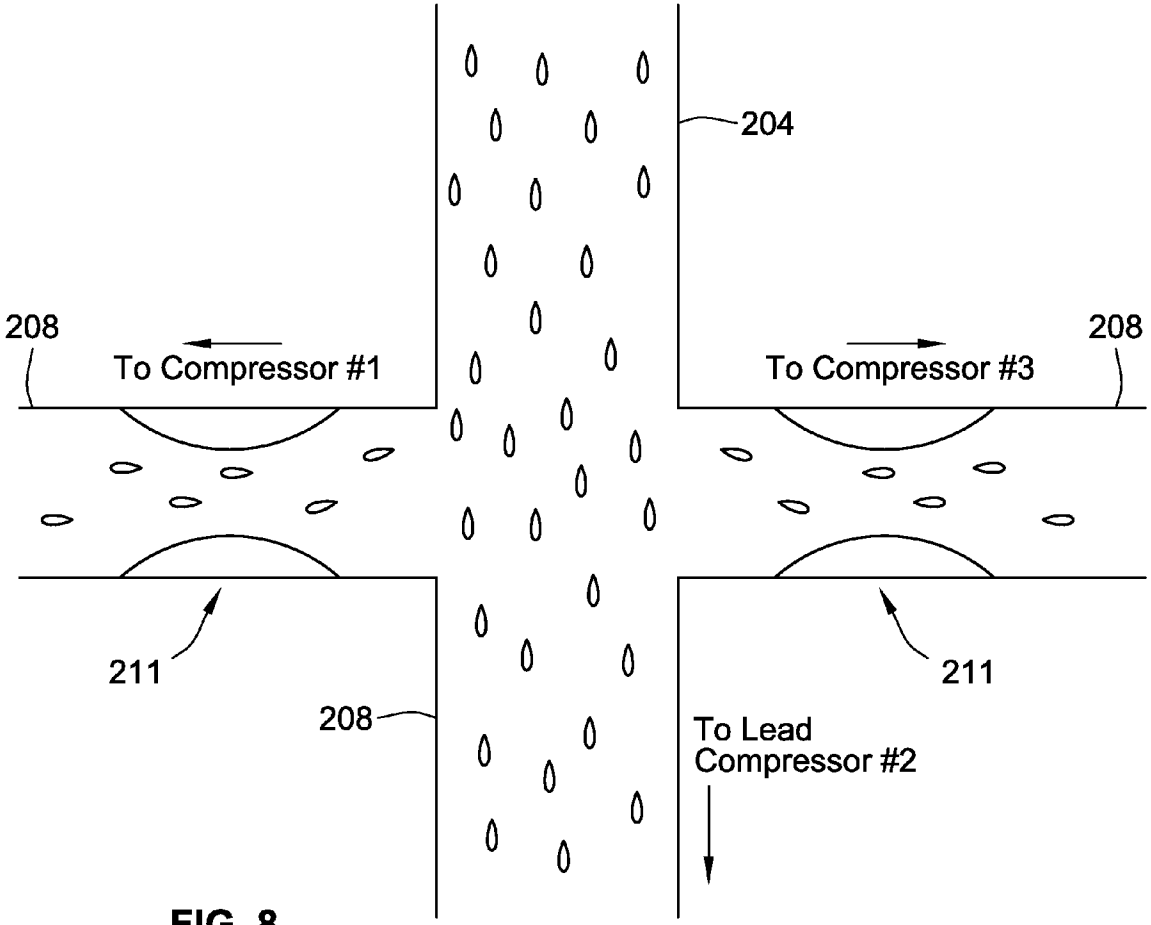
FIG. 8 is a schematic diagram of the common supply line, according to an embodiment of the invention.
Figure 9:
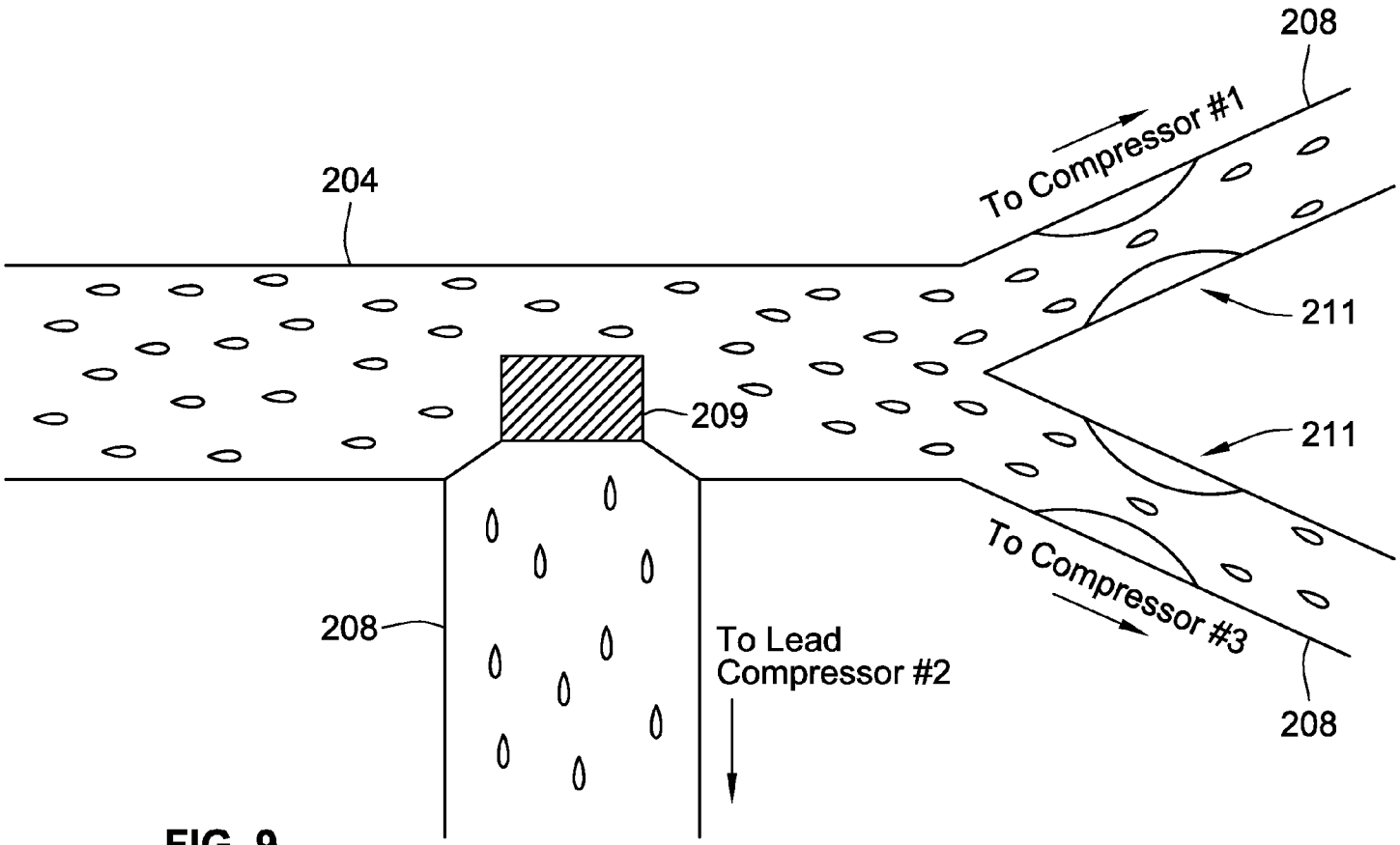
FIG. 9 is a schematic diagram of a common supply line with an oil separator, according to an embodiment of the invention.

FIGS. 8 and 9 are schematic diagrams illustrating exemplary piping configurations. As can be seen in FIG. 8, the inlet supply line 208 leading to the lead compressor #2 202 is larger than the inlet supply lines 208 that lead to the non-lead compressors #1, #3 202. Further, the inlet supply line 208 leading to the lead compressor #2 202 is aligned with the common supply line 204, whereas the inlet supply lines 208 to the non-lead compressors #1, #3 202 are angled at approximately 90 degrees to the common supply line 204. This configuration will result in more of the oil in the flow of refrigerant and oil flowing to the lead compressor #2 202. Moreover, the flow of oil to the non-lead compressors #1, #3 202 is further reduced by restrictions 211 placed in the inlet supply lines 208 to the non-lead compressors #1, #3 202. These restrictions 211 serve to reduce the suction pressure at the inlets 18 (shown in FIGS. 2 and 3) of the non-lead compressors #1, #3 202, such that the suction pressure at the inlets 18 of the non-lead compressors #1, #3 202 is lower than the pressure at the suction inlet 18 of the lead compressor #2 202.

FIG. 9 illustrates a different piping configuration than shown in FIG. 8. In this embodiment, an oil separator 209 is disposed in the common supply line 204. The oil separator 209 may include a steel mesh to coalesce the oil entrained in the refrigerant flow. Alternately, a fibrous filter media may be used to separate oil from the flow of refrigerant. As shown in FIG. 9, once the oil has been extracted from the refrigerant by the oil separator 209, the oil is directed to the inlet supply line 208 for the lead compressor #2 202. FIG. 9 illustrates that gravity may be used to facilitate the flow of oil to the lead compressor #2 202. As can be seen from FIG. 9, a relatively lesser amount of oil flows around the oil separator 209 to the inlet supply lines 208 leading to the non-lead compressors #1, #3 202. As shown, the inlet supply lines 208 to the non-lead compressors #1, #3 202 include restrictions 211 for reducing the suction pressure at the inlets 18 (shown in FIGS. 2 and 3) of the non-lead compressors #1, #3 202, such that the suction pressure at the inlets 18 of the non-lead compressors #1, #3 202 is lower than the pressure at the suction inlet 18 of the lead compressor #2 202.

Figure 10:
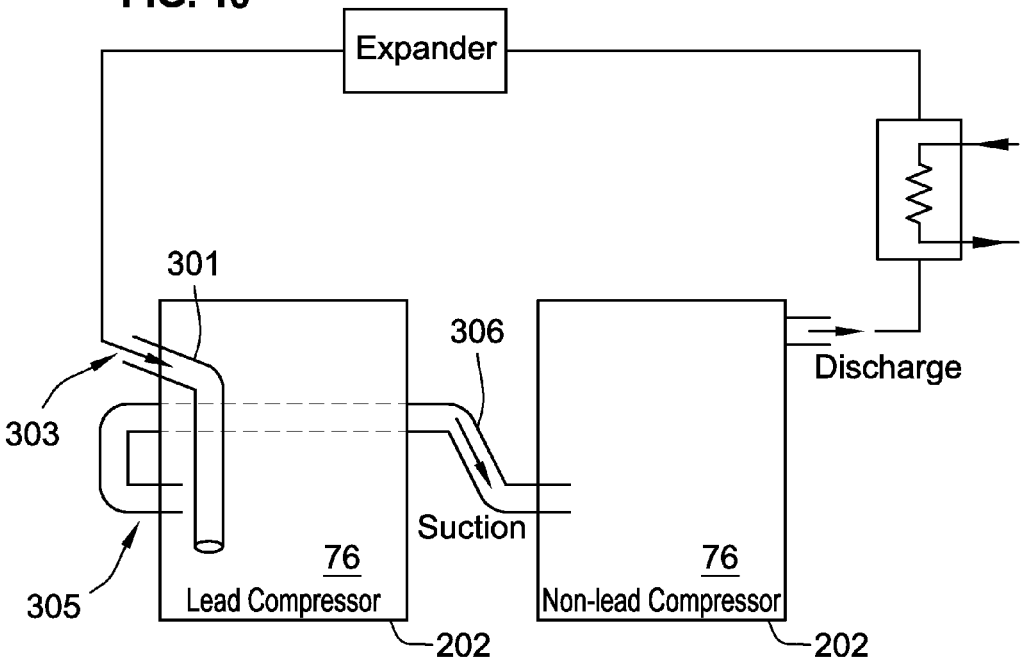
FIG. 10 is a cross-sectional view of a compressor system with a vertical header, in accordance with an embodiment of the invention.

Another embodiment of the invention is shown in FIG. 10, which is a cross-sectional view of a refrigeration system that employs a header 301 within the housing of the lead compressor 202. Two compressors 202 are shown in FIG. 10, though the arrangement shown can be used in a refrigeration system having more than two compressors 202. In the embodiment of FIG. 10, the refrigerant flow and the oil entrained therein are supplied only to the lead compressor 202, from which the refrigerant is distributed to any other non-lead compressors 202 in the system. Refrigerant and oil flows into a port 303 in an upper portion of the compressor housing and into the header 301, which leads down into the oil sump 76. The oil is separated from the refrigerant in the header 301. The separated oil drains into the oil sump 76. The refrigerant flows down the header 301 and some of the refrigerant flows into the compression apparatus of the lead compressor 202, while the remaining refrigerant flows out of a second port 305 in a lower portion of the compressor housing to the non-lead compressors 202 in the system via piping 306.

Referring again to FIGS. 6 and 7, each compressor 202 has an opening 210 through its outer housing 12 (see FIGS. 2 and 3) to the oil sump 76 (see FIGS. 2 and 3) for the compressor 202. A pipe 212 is connected to each opening 210 such that all of the oil sumps 76 for compressors #1, #2, and #3 202 are in fluid communication via pipe 212. In a particular embodiment of the invention, each opening 210 is located at approximately the same position on the outer housings 12 of the compressors 202. Each opening 210 may be located at the same horizontal level, or located at a particular sump level such that the position of each opening 210 represents a minimum level of oil that should be retained in the oil sump 76 before that compressor 202 can distribute its oil to other compressors 202. Locating the openings 210 in this manner allows for oil to flow through the pipe 212 from the lead compressor #2 202 to other operating compressors 202 in need of oil.

In the embodiments shown in FIGS. 6 and 7, the common supply line 204 is configured to return more oil from the flow of refrigerant to the lead compressor #2 202. When the oil level in the oil sump 76 of the lead compressor #2 202 rises above the level of the opening 210 and above the level in non-lead compressors #1 and #3 202 (assuming these compressors are running), the oil sump pressure in the lead compressor #2 202 tends to be higher than that of non-lead compressors #1 and #3 202, thus allowing oil to flow through pipe 212 from the lead compressor #2 202 to the non-lead compressors #1 and #3 202. This flow can take place whether or not the lead compressor #2 202 is running, as long as the oil sump pressure in the lead compressor #2 202 is higher than the oil sump pressure in the receiving compressor 202. In certain embodiments, the oil will continue to be distributed in this manner until the oil sump pressures in the lead compressor #2 202 and the receiving compressor(s) 202 are approximately equal. However, when either or both of the non-lead compressors #1 and #3 202 is not running, the increased oil sump pressure in the non-running or non-operating compressor 202 prevents oil from the lead compressor #2 202 from flowing to that non-running compressor 202.

The combination of providing more oil to the lead compressor #2 202 and configuring the piping to create reduced pressure at the suction inlet port 18 in the non-lead compressors #1 and #3 202 will result in sufficient oil distribution to all of the compressors #1, #2, and #3 202 in this multiple-compressor arrangement, regardless of whether any individual compressor is on or off. Moreover, in particular embodiments, this flow of oil from the lead compressor #2 202 will continue until equalization of the pressures in the compressor #2 202 and in the non-lead compressors receiving the flow of oil. This is shown in the operating matrix below in Table 1.

TABLE 1

| Comp #1 | Sump ΔP | Comp #2 | Sump ΔP | Comp #3 | Description (Running Compressors need oil) |
|---|---|---|---|---|---|
| I | < | I | > | I | #2 receives system oil and feeds #1 & #3 |
| O | > | I | > | I | #2 receives system oil and feeds #1 & #3 |
| 1 | < | O | > | I | #2 receives system oil and feeds #1 & #3 |
| 1 | < | I | < | O | #2 receives system oil and feeds #1 |
| O | > | O | > | I | #2 receives system oil and feeds #3 |
| I | < | O | < | O | #2 receives system oil and feeds #1 |
| O | > | I | < | O | #2 receives system oil |

I = ON;
O = OFF

The above-shown matrix (Table 1) indicates how oil is distributed in the refrigeration systems of FIGS. 6 and 7 when the running compressor(s) need oil. As can be seen from the matrix above, when all of the compressors #1, #2, and #3 202 are running, or if the lead compressor #2 202 is off and the non-lead compressors #1 and #3 202 are running, the lead compressor #2 202 distributes lubricating oil as needed to the non-lead compressors #1 and #3 202. In the case where either, compressor #1 202 is off, or compressor #1 202 and the lead compressor #2 202 are both off, the lead compressor #2 202 provides lubricating oil to the non-lead compressor #3 202. Conversely, when compressor #3 202 is off, or when compressor #3 202 and the lead compressor #2 202 are both off, the lead compressor #2 202 provides lubricating oil to the non-lead compressor #1 202. Finally, when the lead compressor #2 202 is running, and both non-lead compressors #1 and #3 202 are off, the lead compressor #2 202 does not provide any lubricating oil to the non-lead compressors #1 and #3 202.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of operating a refrigeration system using a plurality of compressors connected in parallel, the method comprising:

returning refrigerant and oil to the compressors, the refrigerant also having oil entrained therein;

separating the oil entrained in the refrigerant;

returning most of the oil entrained in the refrigerant to a lead compressor of the plurality of compressors regardless of whether the lead compressor is operating;

connecting the oil sumps of all of the plurality of compressors such that oil is supplied from the lead compressor to at least one non-lead compressor of the plurality of compressors when the at least one non-lead compressor is operating.

2. The method of claim 1, wherein the at least one non-lead compressor comprises two or more non-lead compressors, the method further comprising:

providing a common supply line; and supplying more oil to the lead compressor than is supplied to any of the at least one non-lead compressors of the plurality of compressors.

3. The method of claim 2, further comprising providing, to an inlet port for each of the plurality of compressors, a separate inlet supply line, wherein supplying more oil to the lead compressor comprises restricting the inlet supply lines to each of the at least one non-lead compressors.

4. The method of claim 3, wherein restricting the inlet supply lines reduces suction pressures at the inlet ports of the at least one non-lead compressors.

5. The method of claim 2, further comprising providing an oil separator in the common supply line, the oil separator configured to direct more oil to the lead compressor than to any of the two or more non-lead compressors.

6. The method of claim 1, wherein the plurality of compressors connected in parallel is a plurality of scroll compressors connected in parallel.

7. The method of claim 1, wherein connecting the oil sumps of all of the plurality of compressors comprises locating each end of one or more pipe connections between the oil sumps at the same horizontal level or sump level.

8. The method of claim 7, wherein locating each pipe connection comprises locating each pipe connection so that oil will flow through the pipe from the lead compressor, whether or not the lead compressor is operating, to the at least one non-lead compressors, which is operating, until the oil sump pressures in the oil sumps of the lead compressor and the at least one non-lead compressor are approximately the same.

9. The method of claim 1, wherein each of the compressors discharges refrigerant and oil to a common discharge line.

10. The method of claim 1, wherein connecting the oil sumps of all of the plurality of compressors comprises connecting the oil sumps of all of the plurality of compressors such that oil does not flow from the lead compressor to the at least one non-lead compressor of the plurality of compressors when that non-lead compressor is not operating, wherein the oil does not flow to the non-lead compressor due to a rise in oil sump pressure in the non-lead compressor.

11. The method of claim 1, wherein returning refrigerant to the compressors comprises returning refrigerant to a header in the lead compressor from which the refrigerant is supplied to each of the at least one non lead compressors of the plurality of compressors.

* * * * *